United States Patent [19]

Gaeta

[11] 4,300,732

[45] Nov. 17, 1981

[54] UP-AND-DOWN PULLEY DEVICE FOR SUSPENSION LAMPS AND THE LIKE

[75] Inventor: Marco Gaeta, Monza, Italy

[73] Assignee: Aromec S.r.l., Italy

[21] Appl. No.: 89,673

[22] Filed: Oct. 30, 1979

[30] Foreign Application Priority Data

Apr. 11, 1979 [IT] Italy ..... 21766 A79

[51] Int. Cl.[3] ..... B65H 75/48

[52] U.S. Cl. ..... 242/107.3; 248/330.1; 362/258; 362/404

[58] Field of Search ..... 242/107.3, 107.4 R, 242/107.6, 107.7, 99, 107.15; 362/258, 404–409; 248/329, 330.1; 191/12.2 R, 12.4

[56] References Cited

U.S. PATENT DOCUMENTS

| | | | |
|---|---|---|---|
| Re. 11,067 | 3/1890 | Griswold | 242/107.3 |
| 210,697 | 12/1978 | Lake | 242/107.3 |
| 1,634,578 | 7/1927 | Hummell | 362/404 X |
| 1,738,652 | 12/1929 | Hulse | 362/404 X |
| 2,756,945 | 7/1956 | Robboy | 242/107.15 |
| 3,424,422 | 1/1969 | Klangos | 242/107.4 R X |
| 3,973,656 | 8/1976 | Zumbro | 248/330.1 X |

FOREIGN PATENT DOCUMENTS

| | | | |
|---|---|---|---|
| 591835 | 12/1931 | Fed. Rep. of Germany | 362/404 |

*Primary Examiner*—John M. Jillions
*Attorney, Agent, or Firm*—Steele, Gould & Fried

[57] ABSTRACT

An improved up-and-down pulley device for suspending height adjustable lamps or any other article requiring a regulated descent. The device comprises an adjustable friction system for the lamp descent, wherein the suspension wire winding drum is free to rotate in the wire return or rewinding direction, while its rotation, around a central stationary axis, is braked and regulated by the friction system in the direction of wire unwinding and therefore of lamp descent, rotation being controlled by a ratchet wheel of special structure. The device has a silent, precise and adjustable operation and a compact, sturdy structure comprising a limited number of elements.

17 Claims, 13 Drawing Figures

16
7B
57
58
1
3

17
7A
46
2
19
3
5
50
23

16
7B
57
40A
58
3
1
12

25
26
25A 20B
51
38A
52
50
46
48
20A
24A
44

45A
45C
43
47
49
44
21
23

27A
31A
32
31
30
28
29
23
53
45B
47
21

14
13
14
14

4
41

UP-AND-DOWN PULLEY DEVICE FOR SUSPENSION LAMPS AND THE LIKE

BACKGROUND OF THE INVENTION

1. Field of the Invention

The present invention relates to an up-and-down pulley device for suspension lamps, having considerable structural improvements in comparison with the up-and-down pulley devices presently used for the suspension of height adjustable lamps. Although in this description the term lamp will be always used, it is however to be noted that the up-and-down pulley device of the present invention may be used also to support any other article requiring an adjustable descent.

2. State of Prior Art

Several up-and-down pulley devices for suspension lamps are already known, but even the most improved devices available still have several drawbacks, among which are the noise caused by the internal mechanical members of the device during its operation, the defective blocking of the motion of the lamp suspension wire, as well as of the cable feeding to the lamp the electric current, the great number of elements of which the device consists, with the consequence of the high manufacturing cost, the lack of a universal system of attachment to the ceiling, and the possibility of detachment, misalignment or failure of some elements under stress.

SUMMARY OF THE INVENTION

The up-and-down device according to the present invention overcomes these drawbacks. It is compact, sturdy, formed by a limited number of elements, and has a silent and precise operation which is gradually hand adjustable by means of a locking system with a wing nut arranged in an easily accessible position.

The up-and-down pulley device of the present invention is of the kind operating with the lamp descent friction system, wherein the suspension wire winding drum is free to rotate in the wire return or rewinding direction, while its rotation is braked and regulated by said friction system in the wire unwinding, i.e. lamp descent direction.

One of the fundamental features of the up-and-down pulley device according to the present invention consists of the silent control mechanism for rotation of the lamp suspension wire winding drum. This mechanism comprises a ratchet wheel, that is to say a wheel provided with a saw tooth internal crown, and a pawl journalled on the drum in a position which is eccentric with respect to the single central axis of the ratchet wheel and the drum, which pawl, having an elastic stem always in perfect contact with the central fixed axis during the wire unwinding protrudes and contacts the ratchet wheel teeth, while in the opposite direction is withdrawn, not interfering with the rewinding motion.

Another significant feature is the friction system wherein a friction contact is established between the rigid plastic material of the ratchet wheel and the metal surfaces of a washer and a plate. The disc surface of the ratchet wheel is gradually tightened by means of a wing nut arranged outside the device casing.

Still another important feature is the system by which the electric cable passes into the casing lower closure sleeve. A vertical slot is provided in the casing threaded lower stem, cooperating with a suitably rounded surface of the casing body, and with a locking ring which is inserted on the lower stem between casing body and sleeve, and is provided with several recesses of different sizes, so as to have a recess provided for the passage of each of the most used sizes of electrical cables.

Yet further feature is the system of joining the upper part of the two halves of the casing body with an upper threaded slotted stem so as to allow, by choice, the use of either a ceiling attachment hook or a ring provided with an internally threaded cap for threadably engaging the ceiling attachment rod, so as to have a truly universal up-and-down pulley device which can be applied to all presently available ceiling attachment systems.

According to a further feature of the present invention, in order to give better symmetry and ease of assembly, the central stationary axis consists of two pieces, inserted one into the other, wherein one piece is made of a plastic material and cooperates with other elements of the device also made of plastic material, i.e. pawl, winding drum and casing body, while the other piece is of metal and cooperates with the other elements of the device also made of metal, i.e. said washer and plate forming the friction system of the device, and the relevant wing nut for adjusting said friction. In this way the use and the function of said central stationary axis is perfectly utilized.

BRIEF DESCRIPTION OF THE DRAWINGS

All these considerable features, advantages and objects of the improved up-and-down pulley device according to the present invention will become more apparent from the following detailed description of a preferred embodiment, given as a non-limiting example only, and made with reference to the accompanying sheets of illustrative drawings, in which.

DESCRIPTION OF THE PREFERRED EMBODIMENT

Figure 1:
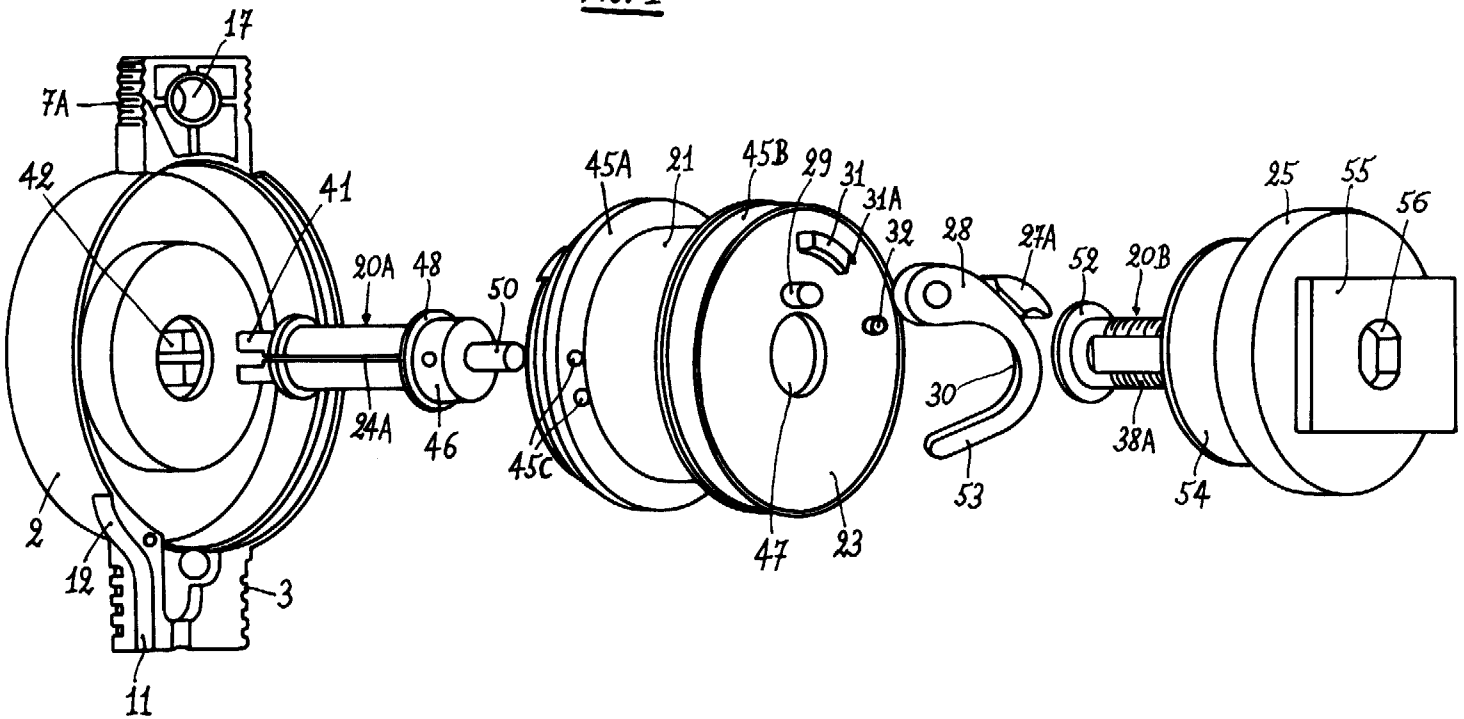
FIG. 1 is an exploded perspective view of the several elements forming the device according to the present invention, to be examined together with FIG. 1A which illustrates the front halfbody of the casing.
Figure 3:
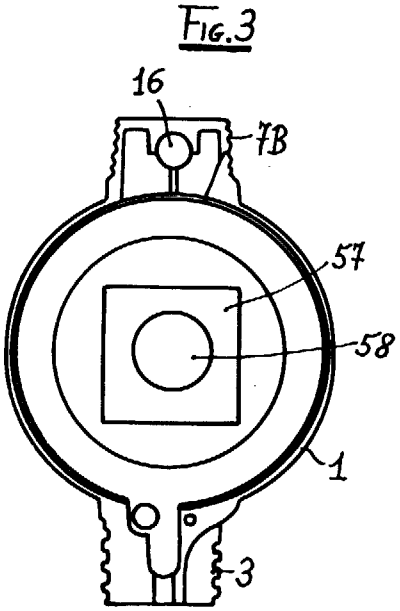
FIG. 3 is a similar front view of the inner side of the open device, showing the front half body of the casing with a seat for a metal plate forming a part of the friction system of the device.
Figure 2:
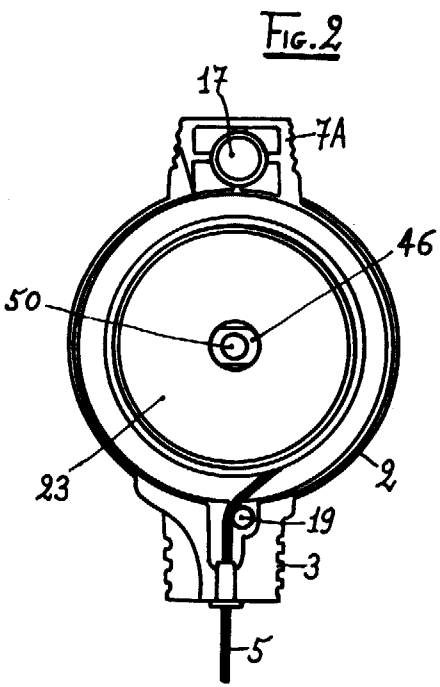
FIG. 2 is a front view of the inner side of the open device, showing the rear half body of the casing containing the winding drum for the lamp suspension wire.
Figure 1A:
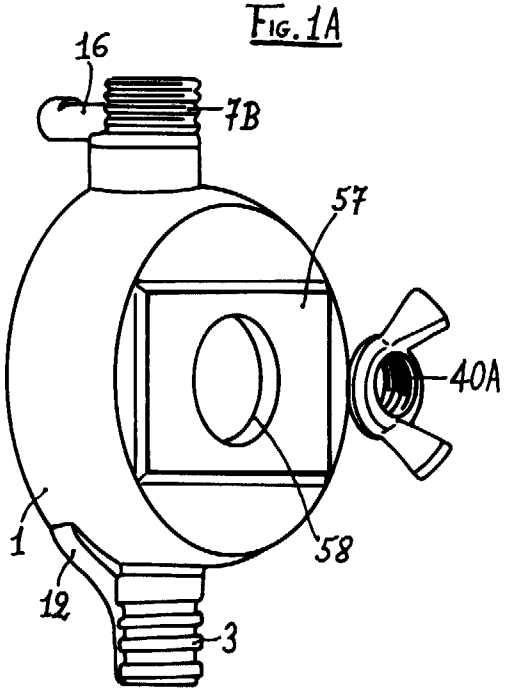
Figures 4A, 4B, 5, 6, 7, 8:
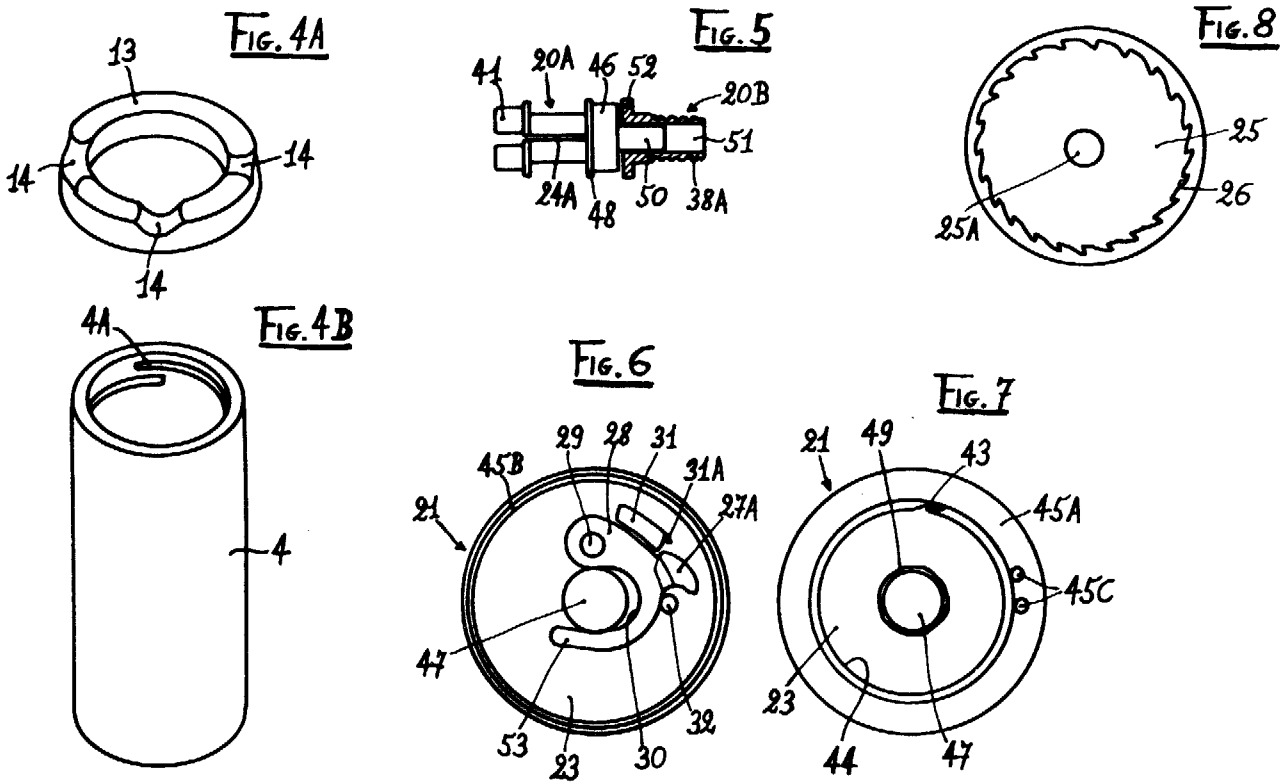
FIGS. 4A and 4B are perspective views of a locking ring for the electric cable at the exit from the casing body and of the casing lower closure sleeve, respectively.
FIG. 5 is a partially sectioned front view of the two piece central stationary axis of the device.
FIG. 6 is a detailed front view of the winding drum, taken from the side where the pawl is disposed, said pawl being shown in the meshing position.
FIG. 7 is a front view similar to FIG. 6, showing the opposite side of the winding drum; i.e. from the side where the recess for arranging the return spring is made.
FIG. 8 is a plan view of the ratchet wheel which cooperates with the pawl.
Figure 9:
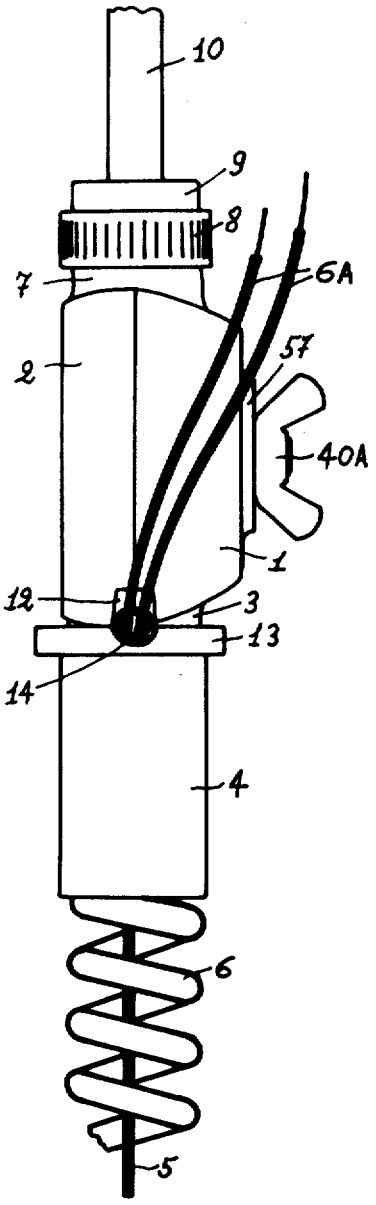
FIG. 9 is a lateral elevational view of the up-and-down pulley device, seen from the outside, assembled with a ceiling attachment rod.
Figure 10:
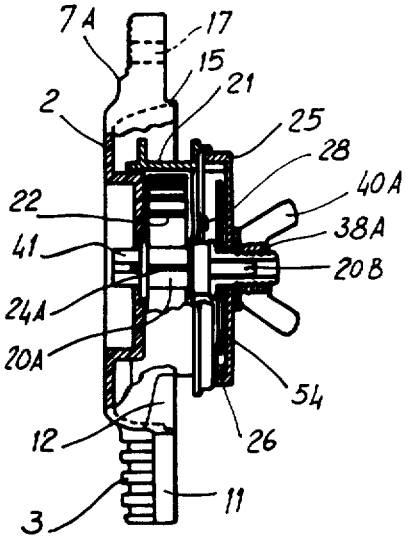
FIG. 10 is a partially sectioned lateral elevational view, showing the inside of the up-and-down pulley device according to the present invention; and, FIG. 11 is a detailed partial view of the upper part of a casing, showing the application of the ceiling attachment hook.

With reference now to the several figures of the accompanying drawings, the up-and-down pulley device according to the present invention consists of a casing whose body is divided into two asymmetrical halves with respect to suspension vertical axis, and more particularly the front half body 1 and the rear half body 2.

At its bottom the casing has a threaded lower stem 3 on which is screwed the inner thread 4A of sleeve 4 from which the lamp suspension wire 5 as well as the electric cable 6 come out. At the top the casing has a threaded stem 7A–7B on which the ring 8 is screwed, said ring 8 having an internally threaded cap 9 for threadably engaging the ceiling attachment rod 10.

The electric cable 6 comes out from the upper part of sleeve 4, in the form of its single-pole leads 6A for the connection to the mains, through the vertical slot 11 of the threaded lower stem 3, cooperating with an overlapping rounded portion 12 of the casing body and with the blocking ring 13, which is freely inserted on said lower stem 3 and is provided with a number of recesses 14 having different sizes, one of said recesses being brought in register with the slot 11 and the rounded portion 12 so as to block the electric cable 6 in such a position. It is clear that for each most common size of electric cable 6, a recess 14 of a corresponding size is provided. Inside the lower stem 3 there is a pin 19 serving as a guide for the suspension wire 5 for its vertical exit from the device without friction.

Figure 11:
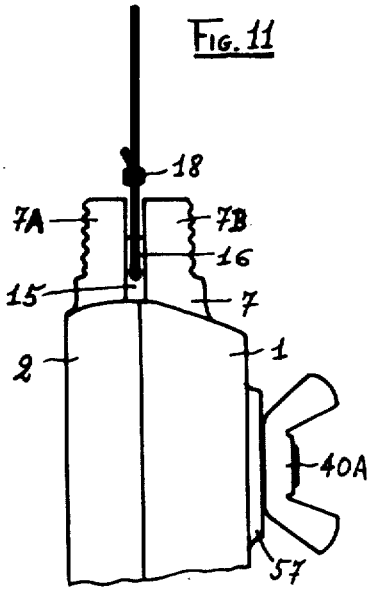

The upper threaded stem 7 of the casing is indeed consisting of two halves 7A–7B each protruding from the corresponding half body 1 or 2 of the casing and cut out so as to leave, when the two half bodies are joined, a wide slot 15 which is crossed by the pin 16 adapted to join the two halves 7A–7B of the threaded stem, by means of its automatic snap insertion into the corresponding hole 17. Pin 16 also acts as an application member for the hook 18 (see FIG. 11) for the ceiling attachment of the device. When the rod 10 is not used the ring 8 is used for tightening said upper threaded stem 7A–7B.

The device casing has an internal stationary central axis formed by two pieces 20A and 20B, of which the first piece 20A is fixed to the rear half body 2 by its fork-like end 41 being inserted into a corresponding dual seat 42 at the center thereof. The body of the piece 20A has a central groove 24A in which the inner end of the spiral blade spring 22 is inserted, whose outer end is inserted into the corresponding notch 43 provided on the wall of the inner chamber 44 of the drum 21, the drum having protruding rims 45A and 45B. On the rim 45A there are holes 45C for fixing the suspension wire end in order to make the attachment loop without causing the wire to protrude beyond the drum outline.

The piece 20A has a thicker neck 46 adapted to be exactly inserted into the hole 47 of the circular closed surface 23 of drum 21, and said neck 46 has a slightly projecting edge 48 contacting a corresponding step 49 provided on the inner face of the hole 47. The piece 20A finally ends with a nose 50 which is insertable into the central bore 51 of the piece 20B. Piece 20B has externally threaded stem 38A to receive the wing nut 40A. The piece 20B has also a base 52 acting as a contact shoulder on neck 46 of the piece 20A.

The lamp descent or unwinding of the suspension wire 5 is regulated by the ratchet wheel 25, comprising a circular plate having a hole 25A for the passage of stem 38A of the piece 20B of the central axis and an inner crown of saw teeth 26 which is engaged by the protruding finger 27A, suitably reinforced and thickened, being part of a pawl 28. Pawl 28 is journalled in an eccentric position with respect to the stationary central axis, on a pin 29 protruding from the lateral surface 23 of drum 21. The pawl 28 has an inner cavity 30 formed by an elastic stem 53 always in contact with neck 46 of the central stationary axis, allowing it to move between a position of engagement with the saw tooth crown 26, defined by shoulder 31, when the drum is rotating clockwise, i.e. in the suspension wire unwinding direction, and a position of disengagement defined by the stop pin 32. The eccentric pivotal mounting of pawl 28, in conjunction with curved stem 53 being in contact with neck 46, causes the pawl to rotate between the engaged and disengaged positions in response to rotation of the winding drum, on which the pawl is mounted. When the drum rotates in the unwinding direction, the pivot pin 29 also rotates in the unwinding direction. This causes the stem to roll over the neck 46 in a manner which drives the pawl radially outwardly, into the engaging position. When the winding drum rotates in the rewinding direction, the stem is rolled or driven over the neck 46 in a manner which pulls the pawl radially inwardly, into the disengaged position. The elastic nature of the stem 53 assures positive contact between the stem 53 and the neck 46. Shoulder 31 moreover has a stop cog 31A for better security against overruning the engagement position, as shoulder 31 becomes worn with time. Stop cog 31A is shaped to make contact with the protruding finger 27A. Thus the protruding finger 27A of pawl 28 is out of contact with (sliding, jumping from tooth to tooth) the crown 26 of the ratchet wheel 25, during the lamp ascent, and at its stop at the desired height, the weight of the lamp causes a slight rotation in the unwinding direction, by which the finger of the pawl is inserted in one of the saw teeth of crown 26 so as to act as a stop. When it is desired to raise the lamp, the manual lifting thereof causes the opposite rotation of drum 21 and therefore release of the protruding finger 27A which remains in its disengaged condition so as to allow free return and rewinding of the suspension wire until the weight of the lamp, when released, causes its stop as soon as the protruding finger 27A engages the first tooth of crown 26 which is met during its movement in the direction opposite to the preceding one.

According to the present invention, the suspension wire unwinding speed is independent of the winding speed and is easily regulated by means of a friction system formed by the friction between two metal surfaces clamping from both sides the circular plate of hard plastic material (e.g. polyamide) of the ratchet wheel 25.

Against the inner face of the circular plate of ratchet wheel 25 and held in position against it by base 52 of piece 20B of the stationary central axis, there is a metal disc or washer 54, while on the outer face of the same circular plate of the ratchet wheel 25 acts a square metal plate 55, provided with a hole 56 with straight sides and rounded apexes, corresponding to the shape of the threaded stem 38A of piece 20B so as to prevent any relative rotation of the elements.

The square plate 55 is arranged in a seat 57 having the same shape and provided on the front half body 1. At the center of seat 57 there is a hole 58 having such dimension to allow that the ring of wing nut 40A may rotate and act directly on the square plate 55. In this way it is apparent that by adjusting the tightening position of wing nut 40A, the pressure is adjusted and therefore the friction exerted by square plate 55 and washer 54 on the ratchet wheel 25 is adjusted and thus the lamp suspension wire unwinding speed is adjusted.

Thus, excepting the square plate 55, the washer 54, the piece 20B of the central stationary axis and the wing nut 40A, forming a group of mutually cooperating metal elements, all the other parts of the device may be made of suitable plastic materials.

Of course it is to be understood that several variations, modifications, additions and substitutions of elements may be resorted to the device according to the present invention, without departing however from its spirit and objects nor from its scope of protection as defined in the appended claims.

I claim:

1. A device for adjustably suspending articles at various heights, having an adjustable friction system for controlling article descent, comprising:

a casing;

means defining a central stationary axis of rotation disposed in said casing;

a suspension wire winding drum freely and rotatably mounted on said axis means;

means for rotationally biasing and winding drum in the rewinding direction;

a braking wheel freely and rotatably mounted on said axis means;

a first metal member on said axis means on one side of said braking wheel;

a second metal member non-rotatably mounted on said axis means on the other side of said braking wheel, said second metal member being further disposed in a corresponding seat in said casing, said axis means including a threaded metal stem portion extending from said second metal member through said casing;

threaded means on said stem for pressably engaging said second metal member, for manually adjusting the pressure of said first metal member and second metal member on said braking wheel; said wheel, first metal member, second metal member seat, stem and manual adjusting means forming said friction system; and, means for connecting said winding drum to said braking wheel in response to said drum rotating in the unwinding direction, said connecting means being disengaged in the opposite direction, whereby descent and positioning of said article is regulated by said friction system and rewinding said wire during ascent of said article is independent of said friction system.

2. A device according to claim 1, wherein the first metal member is a disc freely and rotatably mounted on said axis means.

3. A device according to claim 1 or 2, wherein the second metal member is a plate rotationally fixed in said seat in said casing.

4. A device according to claim 1, wherein said connecting means comprises an inner crown of saw teeth on said braking wheel, forming a ratchet, and a pawl journalled on said drum in an eccentric position with respect to said central axis means and the drum, said pawl having an elastic stem which is always in contact with said central stationary axis means, said pawl being urged into engagement with said saw tooth crown of said wheel in response to rotation of said drum in the unwinding direction, and being urged out of said engagement in response to rotation of said drum in the opposite direction, so as not to interfere with the unwinding motion, and to prevent noise from said pawl sliding on said saw tooth crown.

5. A device according to claim 1, wherein said suspension wire winding drum has an inner chamber, and further comprising a spiral blade spring for rewinding the wire disposed in said chamber, said spring being fixed at one end to an inner wall of said inner chamber and at the other end to an axial slot in said axis means.

6. A device according to claim 4, wherein the pawl is provided with a projecting thickened protruding finger for engaging the saw tooth crown of the ratchet wheel, its outward motion being limited by a shoulder projecting from the winding drum surface, said shoulder being provided with a stop cog to make contact with an edge of the protruding finger.

7. A device according to claim 1, wherein the casing is formed by two assymmetrical, but complementary half bodies, each having half of the upper stem for ceiling attachment and half of the lower stem and further comprising a sleeve, mountable on the lower stem, for guiding the exit of the suspension wire and an electric cable.

8. A device according to claim 7, wherein the two halves of the upper stem are automatically snap joined to each other by a pin protruding from one half body and inserted into a corresponding hole of the other half body, said stem halves being however separated by a slot allowing access to said joining pin by a ceiling attachment hook.

9. A device according to claim 8, wherein the two halves of the upper stem have an outer thread and further comprising a ring attached to the upper stem by an internal threaded bore, and having an upper cap which is also internally bored and threaded and to which a ceiling attachment rod may be threadably attached, so as to allow universal attachment of the device.

10. A device according to claim 7, wherein the lower stem has a complementary slot on each half, cooperating with an overlapping rounded surface of the casing body, so as to allow introduction of the electric cable inside the sleeve, the sleeve being threadably mounted on said lower stem.

11. A device according to claim 10, further comprising a ring inserted between said casing body and said sleeve, said ring having several recesses of different dimensions, each recess adapted for passing and securing each of the most commonly used sizes of electric cables.

12. A device according to claim 4, wherein the means defining the central stationary axis, on which the winding drum rotates, comprises first and second pieces, the first being inserted into the other, being made of plastic material and being inserted in the half body of the casing containing the winding drum and said first piece supporting said drum and also forming a pivot for the rotation of the pawl, while the second piece is made of metal and cooperates with the metal elements forming the friction system for the ratchet wheel.

13. A device according to claim 1, wherein said connecting means comprises a ratchet and pawl assembly, said pawl being journalled into an eccentric position on that side wall of said winding drum facing said braking wheel, said pawl rotating together with said drum.

14. A device according to claim 13, wherein said ratchet is formed integrally with said braking wheel, and said pawl is disposed between said winding drum and said braking wheel.

15. A device according to claim 14, wherein said first metal member is disposed between said pawl and said braking wheel, the integral ratchet extending axially beyond said first metal member toward said pawl.

16. A device according to claim 13, wherein the means defining the central stationary axis comprises first and second pieces, one being inserted into the other, the drum rotating on the first piece and the braking wheel rotating on the second piece.

17. A device according to claim 16, wherein said casing, said first piece of said axis means, said winding drum and said braking wheel are formed from plastic material and said second piece of said axis means is formed from metal, whereby the only non-stationary engagement between metal and plastic members is the frictional engagement of said braking wheel between said second metal member and said second metal member.

* * * * *